US005778785A

United States Patent [19]

Blackwell

[11] Patent Number: 5,778,785

[45] Date of Patent: Jul. 14, 1998

[54] ZONAL INK FOUNTAIN BLADE FOR A ROTARY PRINTING PRESS

[75] Inventor: Joseph Gordon Blackwell, Brenouille, France

[73] Assignees: Heidelberger Druckmaschinen AG, Heidelberg, Germany; Heidelberg Harris, S.A., Montataire Cedex, France

[21] Appl. No.: 740,151

[22] Filed: Oct. 28, 1996

[30] Foreign Application Priority Data

Oct. 26, 1995 [FR] France ..... 95 12641

[51] Int. Cl.[6] ..... B41F 31/04; B41F 31/06

[52] U.S. Cl. ..... 101/365

[58] Field of Search ..... 101/365, 169, 101/157, 350.1, 363; 118/261; 15/256.5

[56] References Cited

U.S. PATENT DOCUMENTS

| | | | |
|---|---|---|---|
| 3,699,888 | 10/1972 | Easoz . | |
| 3,855,927 | 12/1974 | Simeth | 101/350 |
| 5,123,152 | 6/1992 | Tenkula et al. | 29/132 |

FOREIGN PATENT DOCUMENTS

| | | |
|---|---|---|
| 37 07 570 | 9/1988 | Germany . |
| 2 128 551 | 5/1984 | United Kingdom . |
| 2 156 276 | 10/1985 | United Kingdom . |
| 86/07309 | 12/1986 | WIPO . |

*Primary Examiner*—J. Reed Fisher

*Attorney, Agent, or Firm*—Herbert L. Lerner; Laurence A. Greenberg

[57] ABSTRACT

A rotary printing press includes an inking unit with an ink fountain and an ink fountain roller. An ink fountain blade to be disposed in the ink fountain for scraping printing ink from the ink fountain roller includes a base body having a free end region to be associated with the ink fountain roller. The free end region has a plurality of slits formed therein for dividing the free end region zonally into a corresponding number of individual blades and defining zones of contact of the individual blades with the ink fountain roller. A hard-material coating is disposed on the base body in the zones of contact.

13 Claims, 4 Drawing Sheets

ZONAL INK FOUNTAIN BLADE FOR A ROTARY PRINTING PRESS

BACKGROUND OF THE INVENTION

Field of the Invention

The invention relates to an ink fountain blade for a rotary printing press to be disposed in an ink fountain of an inking unit of the rotary printing press for scraping printing ink from an ink fountain roller of the inking unit, wherein a free end region of the ink fountain blade to be associated with the ink fountain roller has a plurality of slits for dividing into zones and forming a corresponding number of individual blades.

Such ink fountain blades are known. They are located inside the inking unit of the rotary printing press and serve to furnish the thinnest possible ink film for printing. Due to the zonal division of the ink fountain blade, individual blades are formed that can be individually adjusted relative to the ink fountain roller, and as a result the layer thickness of the ink film can be specified for an individual zone in accordance with the subject to be printed. Preferably, each individual blade is assigned an actuator to enable adjusting a gap width of the region between the end of each individual free end of an individual blade and the surface of the ink fountain roller from the control panel of the machine. The layer thickness of the ink film of each zone can thus be adapted to given conditions and in order to attain good printing results, a relatively thin layer thickness is often a goal. The layer thickness is determined on one hand by the adjustment of the actuator but on the other hand is also determined by the contact setting of the respective individual blade relative to the ink fountain roller. The print quality is not only determined by the correct alignment of the particular individual blade but also requires that the edges of the individual blades which cooperate with the ink fountain roller be adapted to the contour of the ink fountain roller, and in particular have a correct orientation to the jacket surface. In order to achieve reproducible results over long periods of time, a correctly set-up individual blade should preserve the same parameters for as long as possible. The zonal ink fountain blades known from U.S. Pat. No. 3,699,888 and German Published, Non-Prosecuted Patent Application DE 37 07 570 A1 have deficiencies in that regard.

SUMMARY OF THE INVENTION

It is accordingly an object of the invention to provide a zonal ink fountain blade for a rotary printing press, which overcomes the hereinafore-mentioned disadvantages of the heretofore-known devices of this general type, which assures high reproducibility over a long time and which moreover assures optimal print quality.

With the foregoing and other objects in view there is provided, in accordance with the invention, in a rotary printing press having an inking unit with an ink fountain and an ink fountain roller, an ink fountain blade to be disposed in the ink fountain for scraping printing ink from the ink fountain roller, comprising a base body having a free end region to be associated with the ink fountain roller; the free end region having a plurality of slits formed therein for dividing the free end region zonally into a corresponding number of individual blades and defining zones of contact of the individual blades with the ink fountain roller; and a hard-material coating disposed on the base body in the zones of contact.

The hard-material coating assures that on one hand there is a surface which is optimally adapted to the jacket surface of the ink fountain roller and is substantially resistant to wear. Long times in operation are possible without having to perform readjustment work. This assures the reproducibility of the result of the work. At the same time, the coating allows an especially thin ink layer to be formed, if this thin layer thickness is desired. A special feature is that the base body of the ink fountain blade, which is preferably constructed as an integral component, is provided with the hard-material coating, even though there is a zonal subdivision. In other words, there is a formation of a plurality of individual blades, between which there are slits, so that an individual adjustment of the individual blades can be carried out. According to the invention, it has been demonstrated that despite a usually only very small width of the slits located between the individual blades, a hard-material coating can be applied, without problems arising in the peripheral region of the coating, possibly causing it to collapse, following an individual blade adjustment, for instance.

In accordance with another feature of the invention, the hard-material coating is constructed as a ceramic coating.

In accordance with a further feature of the invention, the ceramic coating has titanium dioxide ($TiO_2$) and in particular, the ceramic coating may have $Al_2O_3$.

In accordance with an added feature of the invention, the hard-material coating is applied to an intermediate layer that has nickel and in particular is constructed as a nickel-chromium intermediate layer, and the intermediate layer is located between the base body and the hard-material coating. A very good bond with the base body is obtained in this way.

In accordance with an additional feature of the invention, the contact zone of each individual blade is constructed as a chamfer on the free end region of the ink fountain blade.

In accordance with yet another feature of the invention, the base body is formed of metal and preferably steel.

In accordance with yet a further feature of the invention, each slit is formed by a narrow slit, originating at the free end of the ink fountain blade, and a wide slit adjoining it. The term "narrow slit" is understood to be a slit with only a very slight width, while a "wide slit" has a greater width.

In accordance with yet an added feature of the invention, in order to prevent printing ink from escaping from the ink fountain through the wide slits, the wide slits are sealed with elastic material. The elasticity of this material makes it possible to adjust an individual blade despite the sealing, or in other words it allows a relative motion of one individual blade with respect to its neighboring individual blade. No sealing provision by introducing sealing material is made inside the narrow slit. Preferably, the slit width of the narrow slit is chosen in such a way that the printing ink cannot pass through it.

In accordance with yet an additional feature of the invention, the hard-material coating is located only on the top of the ink fountain blade, but not in the region of the slits, in particular the region of the narrow slits or the wide slits.

In accordance with a concomitant feature of the invention, a tangent to a surface of the ink fountain roller forms a constant angle of between 3° and 15° with the chamfer of each individual blade.

Other features which are considered as characteristic for the invention are set forth in the appended claims.

Although the invention is illustrated and described herein as embodied in a zonal ink fountain blade for a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
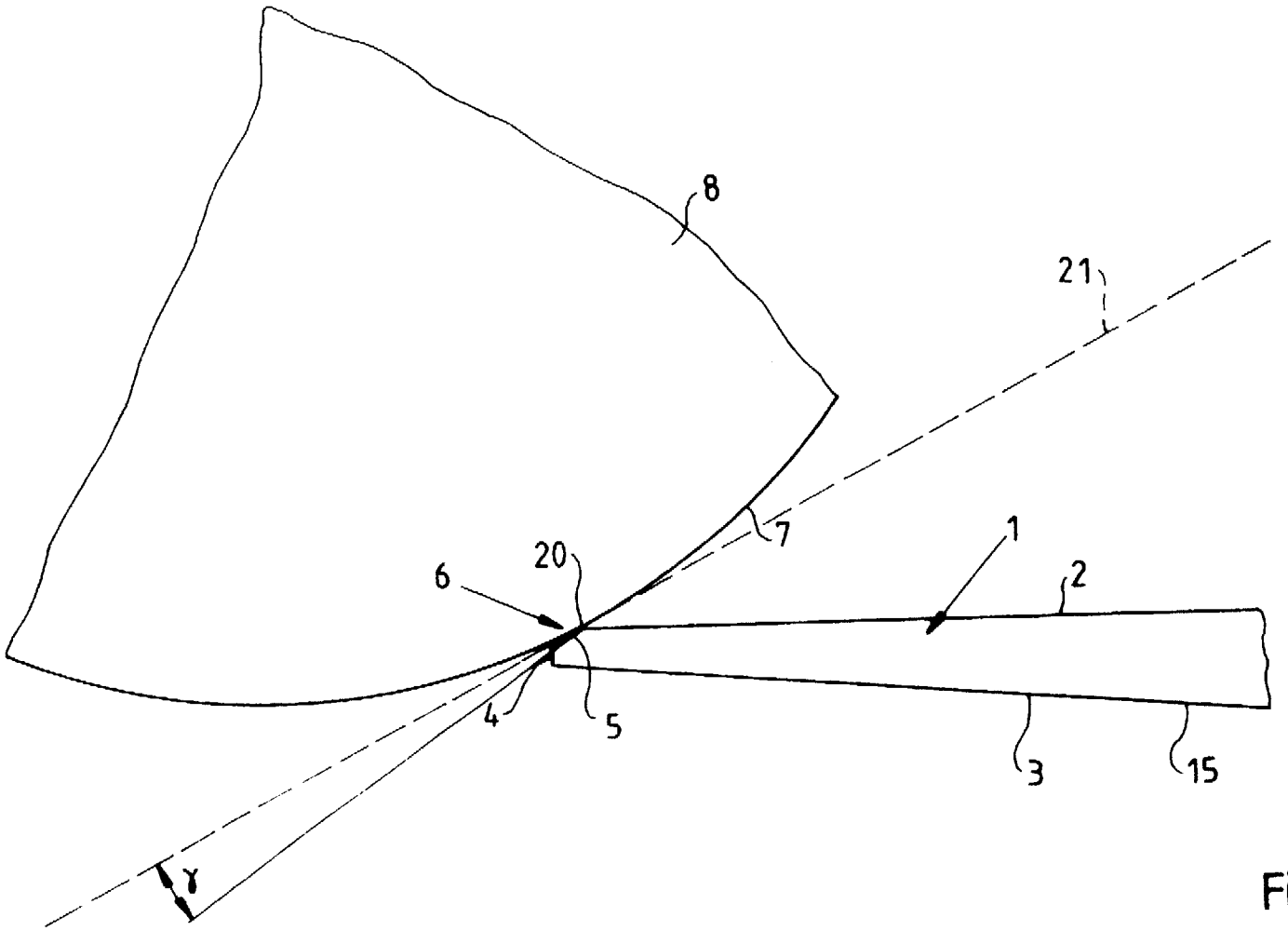
FIG. 1 is a fragmentary, diagrammatic, side-elevational view showing contact of an ink fountain blade with a jacket surface of an ink fountain roller.

Referring now to the figures of the drawings in detail and first, particularly, to FIG. 1 thereof, there is seen an ink fountain blade 1, which is located inside a non-illustrated ink fountain or duct. The ink fountain blade or duct blade 1 has a trapezoidal shape as seen in cross section. In other words, a top 2 and a bottom 3 converge toward a free end 4.

A chamfer 5 which is formed in the region of the free end 4, extends from a surface of the free end 4 as far as the top 2. On the top 2 of the ink fountain blade 1, the chamfer 5 or a portion thereof forms a zone 6 of contact with a jacket surface 7 of an ink fountain roller 8 of an inking unit. A tangent 21 to the surface 7 of the ink fountain roller 8 forms a constant angle $\gamma$ of between 3° and 15° with the chamfer 5.

Figure 2:
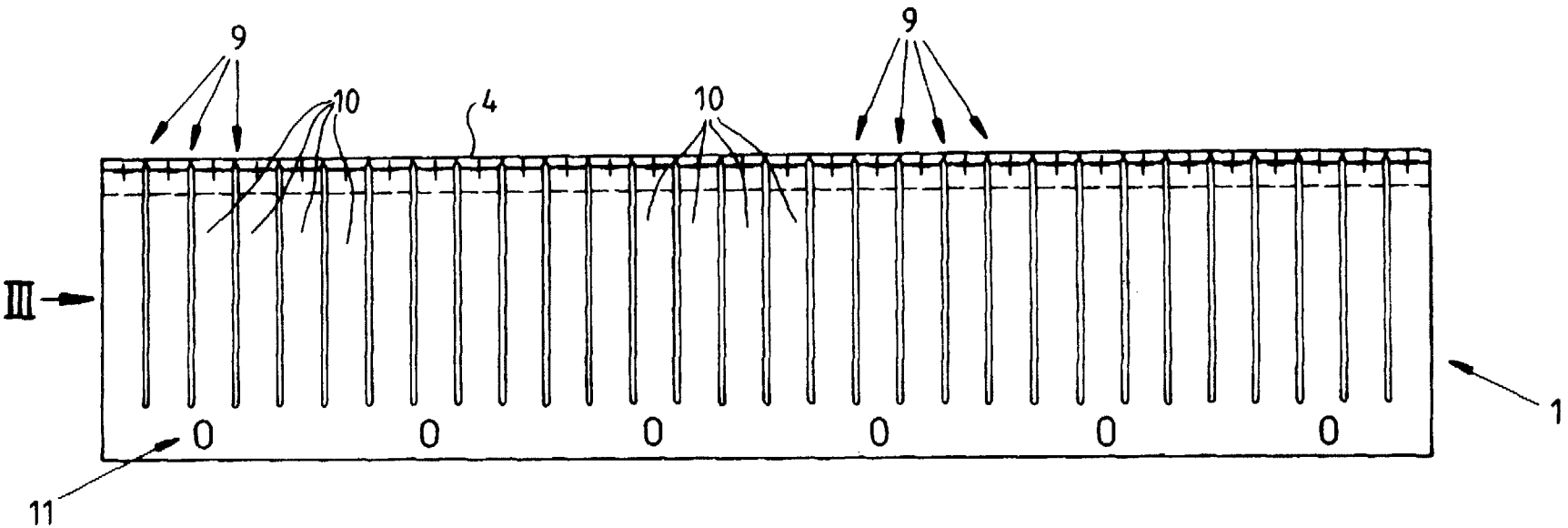
FIG. 2 is an enlarged plan view of the zonal ink fountain blade.

The plan view of FIG. 2 shows clearly that the ink fountain blade 1 is constructed as a zonal ink fountain blade. In other words, through the use of a plurality of preferably parallel, spaced-apart slits 9, it is divided into individual blades 10. The slits 9 originate at the free end 4 of the ink fountain blade 1 and extend into the region of a securing zone 11, which serves to mount the ink fountain blade 1 in the ink fountain. The individual blades 10 are cut free due to the slits 9, so that they are individually adjustable through the use of suitable non-illustrated actuators. In other words, the development of the printing ink layer thickness can be adjusted zonally. In the exemplary embodiment shown in FIG. 2, thirty individual blades 10 and therefore thirty ink zones are provided.

Figure 3:
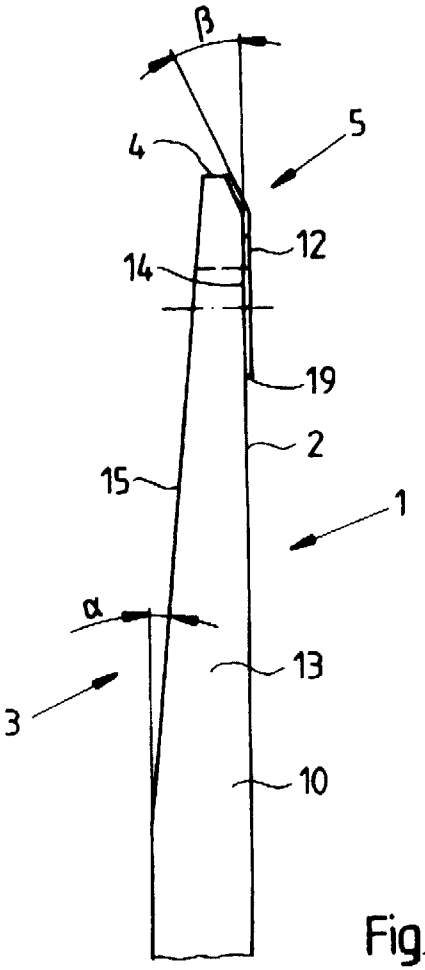
FIG. 3 is a fragmentary, side-elevational view of the ink fountain blade of FIG. 2, as seen in the direction of an arrow III.

The fragmentary view of FIG. 3 shows that a hard-material coating 12 is applied to the top 2 of the ink fountain blade 1. This hard-material coating 12 is located on the chamfer 5 and from there extends over part of the length of the individual blades 10. The ink fountain blade 1 preferably has a base body 13 of steel, which has been first hardened and then annealed again and to which an intermediate layer 14 is applied, at least in the region of the hard-material coating 12. The intermediate layer 14 has nickel and is preferably constructed as a nickel-chromium intermediate layer. The nickel-chromium admixture improves flexing properties, in particular, as well as corrosion resistance. The hard-material coating 12 is applied to this intermediate layer 14. The bottom 3 of the base body 13, which is opposite the top 2, extends parallel to the top in a region remote from the free end 4. In a front free end region, the bottom 3 extends at an angle $\alpha$ of 2° to 10° and preferably 5.5° from the top. The angle $\alpha$ is formed between the region of the bottom 3 that extends parallel to the top 2 and an adjoining inclined surface 15 seen in FIG. 3. It can also be seen from FIG. 3 that the top 2 forms an angle of 15° to 35°, and preferably 25°, with the chamfer 5. This angle is indicated by reference symbol $\beta$.

Figure 4:
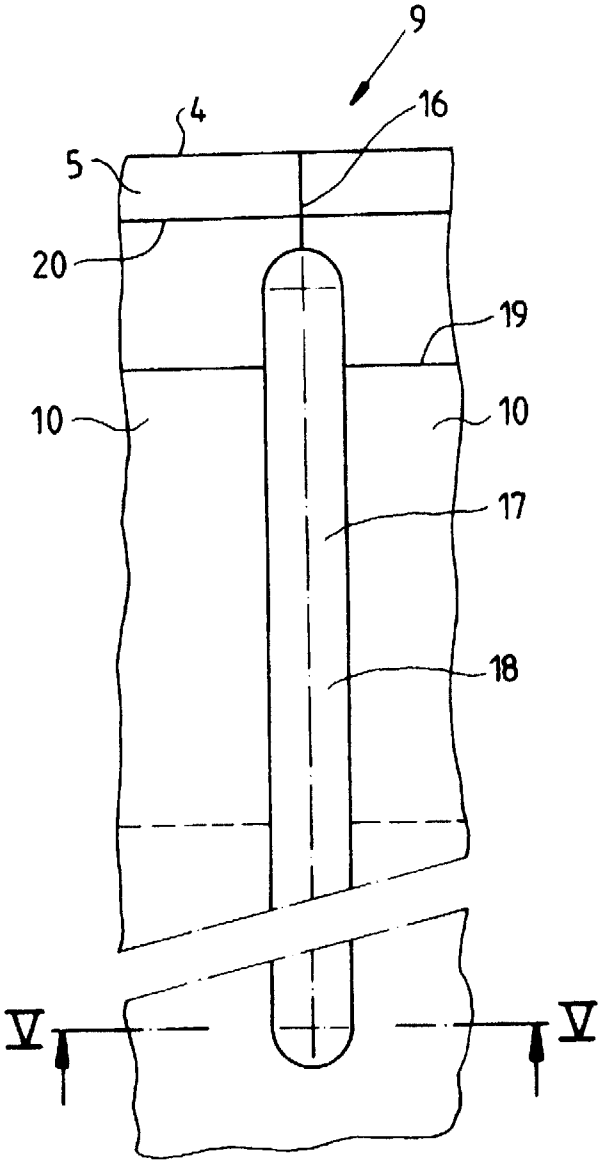
FIG. 4 is a further enlarged, fragmentary, top-plan view of the ink fountain blade.
Figure 5:
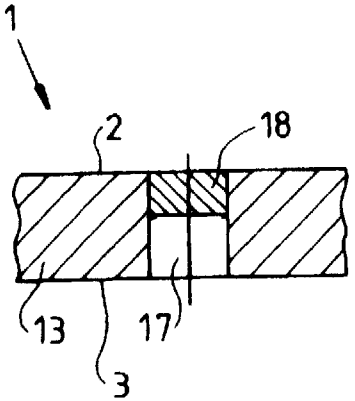
FIG. 5 is a sectional view taken along a line V—V of FIG. 4, in the direction of the arrows.
Figure 6:
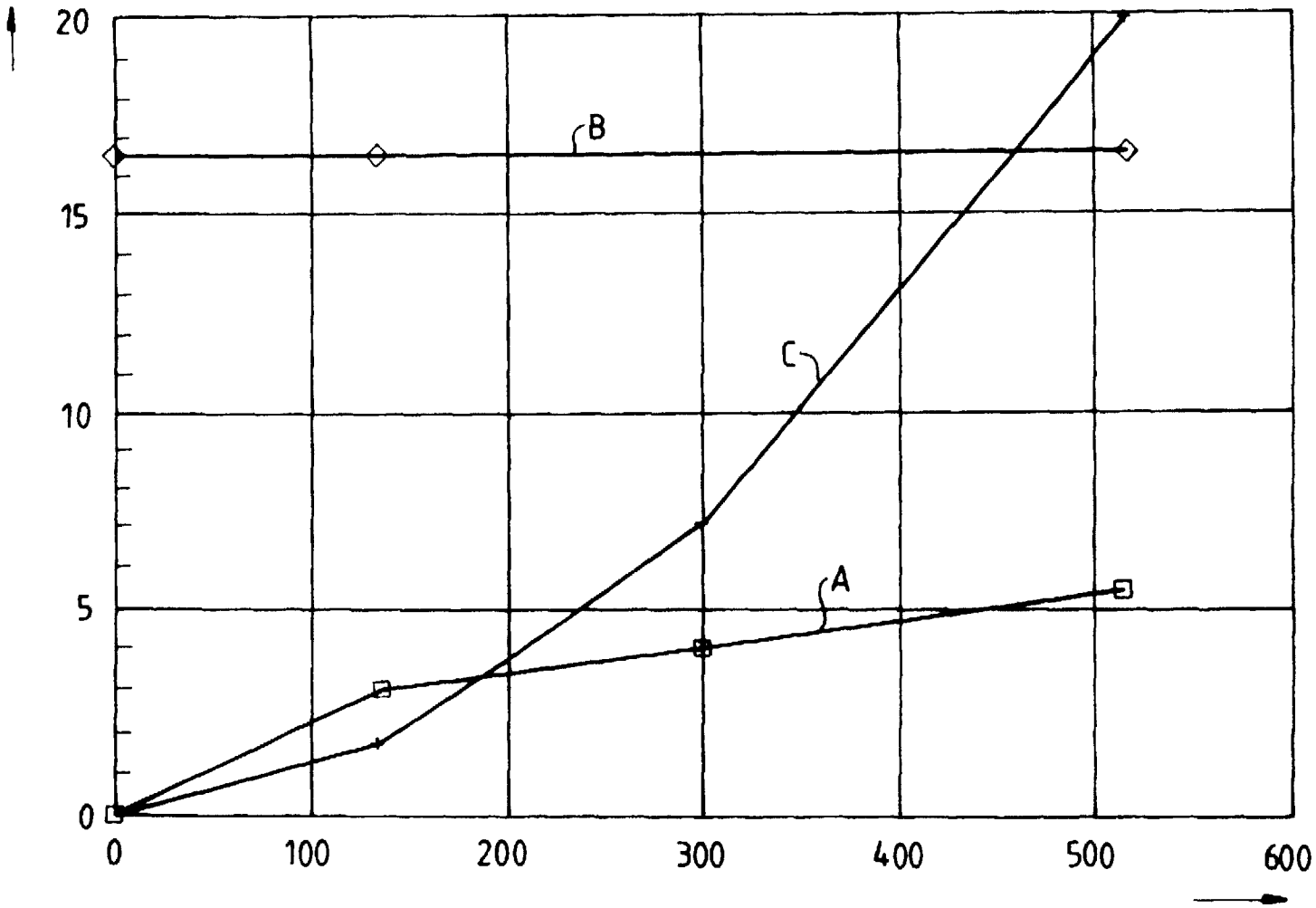
FIG. 6 is a graph in which the wear of ink fountain blades is plotted as a function of time.

FIG. 4 shows that the slits 9 are composed of two parts, wherein a narrow slit 16 beginning at the free end 4 changes over into a wide slit 17. The narrow slit 16 has only a very slight slit width of preferably 0.03 to 0.06 mm. The wide slit 17 has a slit width of 3 mm in particular, and it is sealed with an elastic material 18. Preferably the elastic material is polyurethane or some other suitable material. This material prevents ink from being able to run out of the wide slit 17, yet guarantees mobility on the part of the individual blades 10. Inside the narrow slit 16, there is neither the hard-material coating 12 nor any elastic material 18. The hard-material coating 12 extends over only a portion of the top 2, specifically only on the side facing toward the ink fountain roller 8. The hard-material coating 12 ends in the region of the wide slits 17 (at reference numeral 19) and thus covers the portion that has the narrow slits 16.

The hard-material coating 12 is preferably constructed as a ceramic coating. In particular, it has titanium dioxide ($TiO_2$). It may also have aluminum. It is provided in particular that the hard-material coating 12 has a mixture of $Al_2O_3$ and a few percent of titanium dioxide $TiO_2$, such as 1–5% $TiO_2$. It is preferably applied by plasma methods.

The graph of FIG. 8 shows the wear of an ink fountain blade as a function of the time in operation.

Immediately after being put into operation, the hard-material coating 12 optimally fits the contour of the top of the ink fountain roller 8. This is accomplished in such a way that no readjustment work is necessary, as would be the case, for instance, in an assembly with clamp elements for the ink fountain blade, where fastening forces act on the ink fountain blade from below. As the course of a curve A shows, the wear during the time in operation is very slight. It can be seen that the ink fountain blade can still be used for a relatively long time. Even after about 500 hours in operation, the wear of the hard-material coating 12 is still moderate.

In order to provide a comparison, a curve C shows the wear of a conventional ink fountain blade as a function of the time in operation. The curve C shows markedly greater wear, as compared with that which the ink fountain blade 1 of the present invention suffers, even after only a short time in use.

Finally, a curve B shows the level of wear up to which conventional ink fountain blades are generally used.

I claim:

1. In a rotary printing press having an inking unit with an ink fountain and an ink fountain roller, an ink fountain blade to be disposed in the ink fountain for scraping printing ink from the ink fountain roller, comprising:

a base body having a free end region to be associated with the ink fountain roller;

said free end region having a plurality of slits formed therein for dividing said free end region zonally into a corresponding number of individual blades and defining zones of contact of said individual blades with the ink fountain roller, said individual blades at said zones of contact being chamfers and a tangent to a surface of the ink fountain roller forming a constant angle of between 3° and 15° with each of said chamfers;

a hard-material coating disposed on said base body in said zones of contact; and an intermediate layer having nickel, said intermediate layer being located between said base body and said hard-material coating, and said hard-material coating being applied to said intermediate layer.

2. The ink fountain blade according to claim 1, wherein said hard-material coating is a ceramic coating with flexing properties.

3. The ink fountain blade according to claim 2, wherein said ceramic coating has titanium dioxide.

4. The ink fountain blade according to claim 2, wherein said ceramic coating contains $Al_2O_3$.

5. The ink fountain blade according to claim 1, wherein said intermediate layer is formed of nickel-chromium.

6. The ink fountain blade according to claim 1, wherein said base body is formed of metal.

7. The ink fountain blade according to claim 1, wherein said base body is formed of steel.

8. The ink fountain blade according to claim 7, wherein said steel base body is hardened.

9. The ink fountain blade according to claim 7, wherein said steel base body is hardened and then annealed.

10. The ink fountain blade according to claim 1, wherein each slit includes a narrow slit originating at said free end and a wide slit adjoining said narrow slit.

11. The ink fountain blade according to claim 10, including an elastic material sealing said wide slit.

12. The ink fountain blade according to claim 10, wherein said base body has a top, and said hard-material coating is located only on said top but not in said narrow slit.

13. The ink fountain blade according to claim 10, wherein said base body has a top, and said hard-material coating is located only on said top but not in said narrow slit nor in said wide slit.

* * * * *